US006248443B1

(12) United States Patent
Fernandez et al.

(10) Patent No.: US 6,248,443 B1
(45) Date of Patent: Jun. 19, 2001

(54) PROCESS FOR THE PREPARATION OF FLEXIBLE CARBON YARN AND CARBON PRODUCTS THEREFROM

(75) Inventors: Ramon B. Fernandez, Harbor City; Kenneth A. DeVane, Huntington Beach, both of CA (US)

(73) Assignee: Hitco Carbon Composites, Inc., Gardena, CA (US)

( * ) Notice: Subject to any disclaimer, the term of this patent is extended or adjusted under 35 U.S.C. 154(b) by 0 days.

(21) Appl. No.: 08/218,892

(22) Filed: Mar. 28, 1994

(51) Int. Cl.[7] ..... B32B 9/00
(52) U.S. Cl. ..... 428/367; 428/368; 428/375
(58) Field of Search ..... 428/367, 368, 428/375

(56) References Cited

U.S. PATENT DOCUMENTS

| | | | | |
|---|---|---|---|---|
| Re. 34,820 | * | 1/1995 | Lubowitz et al. | 428/367 |
| 198,787 | | 1/1878 | Birch . | |
| 373,193 | | 11/1887 | Rau . | |
| 972,110 | | 10/1910 | Horton . | |
| 2,341,219 | | 2/1944 | Jones | 117/46 |
| 3,113,349 | | 12/1963 | Nottebohm et al. | 19/161 |
| 3,150,416 | | 9/1964 | Such | 19/161 |
| 3,837,904 | * | 9/1974 | Hill | 428/367 |
| 3,908,042 | | 9/1975 | Heissler et al. | 427/172 |
| 3,914,504 | * | 10/1975 | Weldy | 428/367 |
| 3,969,565 | | 7/1976 | Forrest | 265/284 |
| 4,364,993 | * | 12/1982 | Edelman et al. | 428/367 |
| 4,394,467 | * | 7/1983 | Edelman | 428/367 |
| 4,443,566 | * | 4/1984 | Yinz | 428/367 |
| 4,446,255 | * | 5/1984 | Ying et al. | 428/367 |
| 4,522,883 | | 6/1985 | Wallace et al. | 428/365 |
| 4,654,264 | * | 3/1987 | Asai et al. | 428/367 |
| 4,751,258 | * | 6/1988 | Minami | 428/367 |
| 4,816,195 | | 3/1989 | Hettinger, Jr. et al. | 264/29.2 |
| 4,871,491 | | 10/1989 | McMahon et al. | 264/29.2 |
| 4,883,712 | * | 11/1989 | Ogawa et al. | 428/367 |
| 4,891,267 | * | 1/1990 | Takahashi et al. | 428/367 |
| 4,918,117 | * | 4/1990 | Snow et al. | 428/367 |
| 4,923,752 | * | 5/1990 | Cornelia | 428/367 |
| 5,137,781 | * | 8/1992 | Lahijani et al. | 428/367 |
| 5,230,956 | * | 7/1993 | Cole et al. | 428/367 |
| 5,239,046 | * | 8/1993 | Lubowitz et al. | 428/367 |
| 5,252,168 | * | 10/1993 | Johnston et al. | 428/367 |
| 5,334,419 | * | 8/1994 | Minami et al. | 428/367 |
| 5,369,146 | * | 11/1994 | Miller et al. | 428/367 |

FOREIGN PATENT DOCUMENTS 0189134 1/1986 (EP) .

* cited by examiner

*Primary Examiner*—C. H. Kelly
*Assistant Examiner*—J. M. Gray
(74) *Attorney, Agent, or Firm*—Renner, Kenner, Greive, Bobak, Taylor & Weber

(57) ABSTRACT

A process for the preparation of a carbon yarn product includes the steps of pyrolizing raw carbonaceous yarn comprising a plurality of carbon fibers, at a temperature above about 650° F.; flexing the pyrolized yarn to substantially break fiber-to-fiber bonding between the fibers; and, exposing the yarn to a temperature sufficient to carbonize the pre-carbonized yarn to a final and higher carbon assay. A flexible yarn element (10) includes a plurality of carbon filaments (11) wherein each filament (11) is in contact with at least one other filament 11. A sizing material at least partially coats the plurality of filaments (11), wherein the sizing material of each filament (11) is substantially separated from the sizing material of the at least one other filament (11) in contact therewith.

9 Claims, 2 Drawing Sheets

PROCESS FOR THE PREPARATION OF FLEXIBLE CARBON YARN AND CARBON PRODUCTS THEREFROM

TECHNICAL FIELD

The present invention generally relates to a carbon yarn and carbon yarn products. More particularly, the invention relates to a carbon yarn which is flexible after being carbonized. Specifically, the present invention relates to a carbon yarn product which is flexed after pre-carbonizing to break fiber-to-fiber bonds between the yarn filaments.

BACKGROUND OF THE INVENTION

Carbon yarn products are used in many applications such as in the preparation of carbonized fabrics for composite reinforcement and the like. An example of a carbonized fabric is found in U.S. Pat. No. 972,110. Often, a number of carbon-based filaments are bound together such as by twisting, to form a yarn element. Individual yarn elements are then further processed such as by twisting a number of elements to form a cord, or weaving the elements to form a cloth or fabric.

In industries using carbonizable yarn, such as carbonized fabric industries or the like, the first step in manufacturing the carbon yarn is to remove any sizing materials such as starch, mineral oil, wetting agents or "surfactants" or the like, from the raw yarn. This procedure is known as "scouring" and usually includes cleaning the yarn with a dry cleaning solvent such as perchloroethylene or another similar scouring agent. Sizing materials are often applied to carbonizable filaments during the formation of the yarn products to prevent damage during subsequent processing to prepare the yarn. Such subsequent processing may include twisting, spooling, weaving or the like. The sizing material is applied to the yarn product to help prevent damage during such processing.

However, if the sizing is not removed from the carbonizable yarn prior to carbonizing, the resulting carbon yarn product is stiff, brittle, weak and is generally not useable or further processible. This has been determined to be caused, it is believed, by bonding between the individual filaments of the yarn. The bonding is likely caused by the reaction of the sizing material between the filaments during carbonization procedures. The sizing material is present on the raw filaments, and it might be intentionally not removed from the filaments or its removal might be non-uniform. In either case, the resulting carbon yarn product is deficient for the reasons as stated hereinabove.

Unfortunately, perchloroethylene and other scouring solvents have come under scrutiny and regulation, and their use has become increasingly undesirable. A need exists therefore, for a flexible and strong carbon yarn which is prepared without a solvent scouring step.

SUMMARY OF INVENTION

It is therefore, an object of the present invention to provide a strong and flexible carbon yarn and products thereof.

It is another object of the present invention to provide a strong and flexible, rayon-based carbon yarn and yarn products.

It is still another object to provide a process for the preparation of a strong flexible carbon yarn.

At least one or more of the foregoing objects, together with the advantages thereof over the known art relating to carbon yarn, which shall become apparent from the specification which follows, are accomplished by the invention as hereinafter described and claimed.

In general the present invention provides a process for the preparation of a carbon yarn product which comprises the steps of pyrolizing raw carbonaceous yarn comprising a plurality of carbon fibers, at a temperature above about 650° F.; flexing the pyrolized yarn to substantially break fiber-to-fiber bonding between the fibers; and, exposing the yarn to a temperature sufficient to carbonize the carbon.

PREFERRED EMBODIMENT FOR CARRYING OUT THE INVENTION

The present invention is directed toward a carbon yarn product. More particularly, the present invention provides a flexible, non-scoured, preferably rayon-based carbon yarn. Heretofore, it has been necessary to scour rayon yarns prior to carbonization in order to remove the sizing materials applied prior to processing. Otherwise, the resulting carbonized yarn is stiff and brittle and essentially useless for further processing. It is not an acceptable solution to merely not size the yarn, because sizing is necessary for handling the raw yarn for further processing thereof. The present invention provides a flexible carbon yarn from which the sizing material has not necessarily been removed. Because many scouring solvents have been or will be regulated, it is desirable to provide a yarn product which is flexible and yet which has not been scoured.

As used herein, the term "carbon yarn" shall be used to connote an element which is made up of a plurality of individual carbon-based filaments. A "yarn product" is an article or the like formed from the yarn, such as a fabric or other article. A filament is simply a strand of the carbon material, and a plurality of filaments may be brought together such as by twisting, or the like, to form a larger element. Each filament in an element therefore, is in contact with at least one other filament in the element and may be in contact with a plurality of other filaments. A number of elements may themselves be brought together to form a cord and so on. Although the terms filament, element, cord and the like are arbitrarily chosen, they have accepted meanings in the industry, allowing relative size determinations to be made and conveyed. No other limitations are to be imputed to the present invention as a result of the use of these terms.

Figure 1:
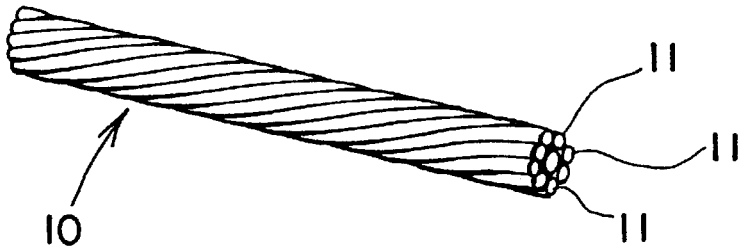
FIG. 1 is a side elevational, fragmentary view of a yarn element made from a plurality of filaments twisted together.
Figure 2:
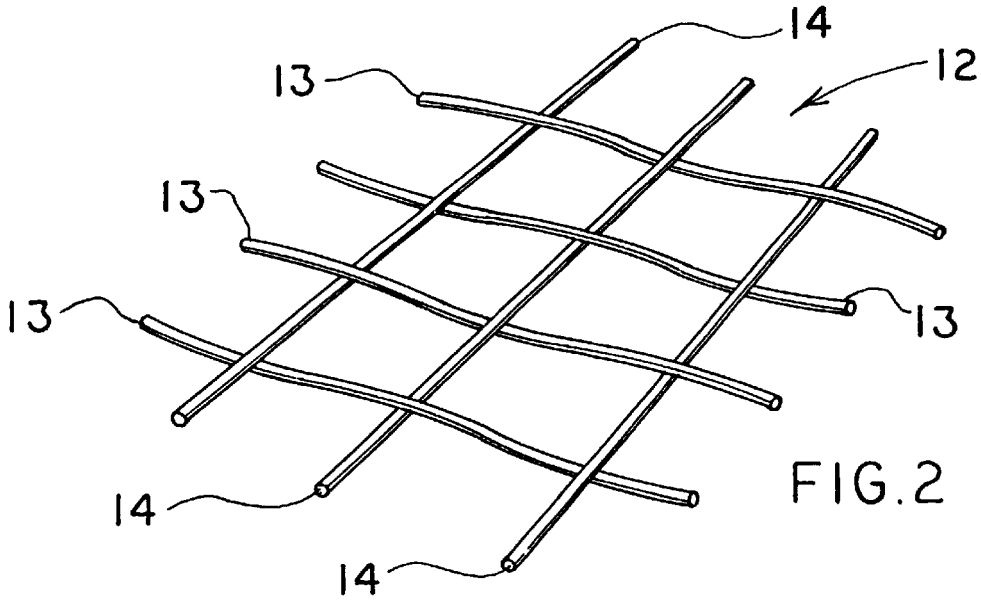
FIG. 2 is a perspective, fragmentary view of a fabric formed by weaving a number of elements as in FIG. 1.

For purposes of illustration, FIG. 1 shows a yarn element 10 which is made up of a number of individual filaments or fibers 11. Filaments 11 are twisted together to form element 10. A plurality of elements 10 may be used for example, to weave a fabric 12 (FIG. 2) having warp elements 13 and fill elements 14.

Each filament 10 according to the present invention, is formed from a carbonaceous material, such as rayon, polyacrylonitrile, pitch, phenolic resins, and the like. Such carbonaceous materials may be readily carbonized by exposure to elevated temperatures. It has been found that during carbonization procedures, the sizing materials which have been at least partially coated onto the filaments 11 prior to twisting to form element 10, or prior to other similar processing, bonds with the sizing on adjacent filaments 10. The resulting yarn is stiff and brittle due to this inter-filament bonding.

In order to provide a strong and flexible carbon yarn, the present invention employs conventionally sized, raw, i.e., non-carbonized, non-scoured yarn, and subjects the yarn to a pre-carbonization process by exposing the yarn to elevated temperatures sufficient to cause bonding of the sizing material. For example, a rayon-based carbonaceous yarn such as carbonizable bright rayon having 720 filaments/1650 denier, such as is commercially available from North American Rayon Corp. and Grupo Cydsa and others, and sized with mineral oils, may be subjected to a temperature cycle reaching above about 650° F., such as from about 650° F. to about 750° F., for a period of time sufficient to cause the inter-filament bonding. The time period will of course vary, such as from about 5 to about 14 days. This pre-carbonization pyrolysis may be accomplished by conventional heating techniques. After the pre-carbonization pyrolysis is completed, the stiff and brittle yarn is subjected to a flexing operation to now be described.

The pre-carbonized yarn is subjected to a mechanical working, kneading or flexing procedure whereby the yarn is flexed, thereby mechanically and substantially separating or breaking the bonds between the sizing of adjacent filaments. The flexed yarn is then fully carbonized at a temperature sufficient to carbonize the yarn, such as by exposure to temperatures above about 2000° F. and as high as 4500° F. or higher, depending upon the desired properties of the carbon yarn, and the desired carbon assay. One preferred range for the final carbon content or "assay" is from about 90 to 100 percent, which will of course, vary depending upon the expected end use of the material.

Figure 3:
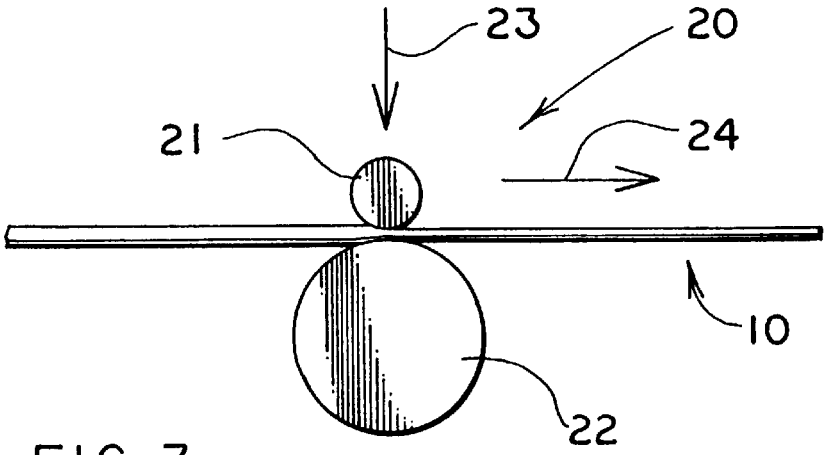
FIG. 3 is a side elevational view of a portion of a flexing apparatus according to the present invention.
Figure 4:
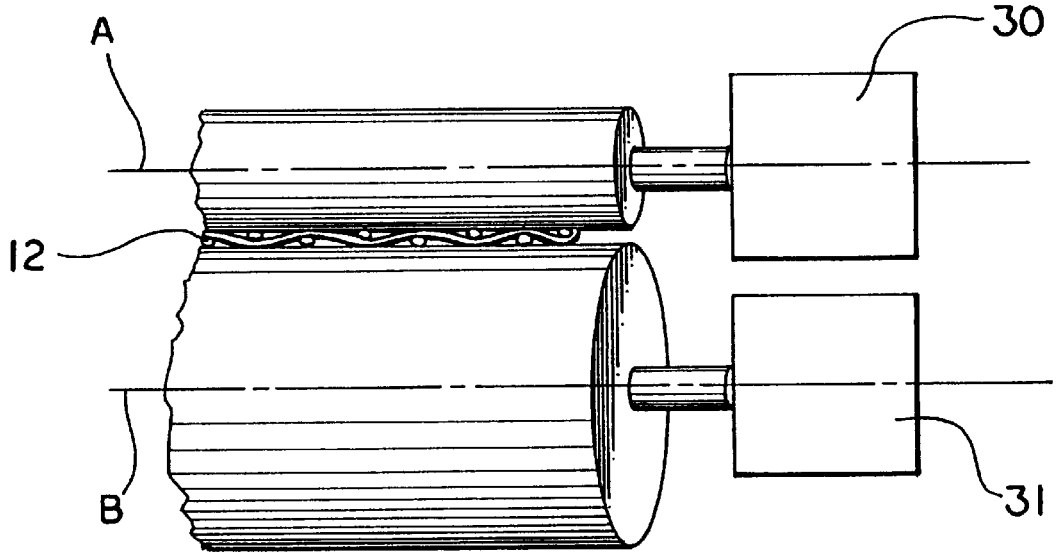
FIG. 4 is a partially schematic front elevational view of the flexing apparatus as in FIG. 3; and, FIG. 5 is a close up view of a portion of the flexing apparatus of FIG. 3.

Flexing of the yarn according to the present invention is preferably accomplished by applying an equal and opposite force upon opposing sides of the yarn or yarn product. This is preferably accomplished by employing a flexing apparatus 20 (FIG. 3) having a pair of rotatable opposed rolls 21 and 22 which are placed in peripheral contact with for example, element 10. The center of roll 21, axis A in FIG. 4, is preferably parallel to axis B of roll 22, and rolls 21 and 22 are rotatable on their respective axis A and B. Furthermore, at least one roll, such as roll 21, is moveable in a direction indicated by arrow 23 (FIG. 3), substantially perpendicular to the direction of travel of element 10 which is shown by arrow 24 in FIG. 3. As will be appreciated, the relationship as described with respect to the movement of roll 21 and the direction of travel of element 10 may be of an angle other than 90 degrees representing a perpendicular arrangement, and still be within the scope of the invention.

Movement of a roll such as roll 21 may be accomplished by any conventional method, either by being manually or automatically controlled. Because the means of accomplishing such movement is not a limitation of the invention, drive unit means 30 for accomplishing such movement is schematically represented in the drawings. It will be appreciated then, that roll 21 is selectively moveable transversely to its axis of rotation A, such that the force exerted upon the element 10 is selectively adjusted by moving roll 21. Further, drive unit 30 may also be employed to rotate roll 21 on its axis A, or another means of accomplishing rotation of roll 21 (not shown) may be employed without limitation. A similar drive unit 31 may be operatively connected to roll 22.

Figure 5:
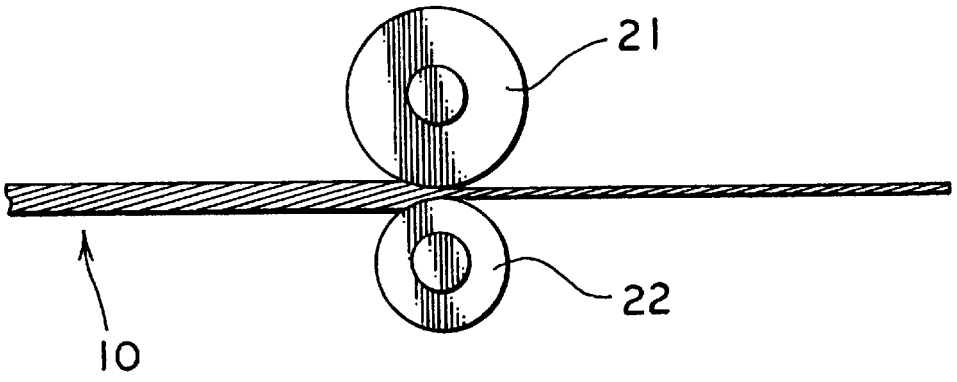

As shown in FIG. 5, yarn element 10 may be compressed between rollers 21 and 22, thus breaking inter-fiber and inter-filament bonding. The size of rollers 21 and 22 will vary with respect to each other, the means of rotating one or both, and the yarn element to be flexed. The rollers 21 and 22 are shown in the drawings as being of different sizes, all of which are within the scope of the invention.

The distance of movement of roll 21 and hence the flexural pressure exerted upon the yarn being processed is, of course, dependent upon the nature of the yarn, the thickness of the yarn, the amount of sizing and the strength of inter-element bonding, and the like. By way of example, for a rayon-based carbon yarn fabric, such as is commercially available from for example, Highland Industries, having about 720 filaments per element and a denier of 1650 sized with mineral oil and having been pre-carbonized by exposure to 700° F. for 12 hours, the required equal and opposite force exerted upon the fabric would be about 3 pounds/inch for 10 times. By "for 10 times" it is meant that the yarn is flexed by 10 pair of rollers 21 and 22 at the given force. By way of example only, the equal and opposite force exerted upon an average rayon-based carbon yarn or carbon yarn product may vary from about 2 to about 5 pounds/inch for from about 5 to about 12 times.

It has been found that passing the yarn through a series of sinuous path rollers, that is, with no equal opposing force being applied to the yarn, will not be sufficient to break the inter-filament sizing bonds. Sinuous path rollers work for yarns which are only mildly fiber bonded. Severely fiber bonded yarns are brittle and will break in a sinuous path. For a sinuous path to work effectively requires a small roller diameter and acute angles for its path. Furthermore, sinuous paths will have virtually no effect on the fill yarn in the fabric. Because the fill yarns are parallel to the length of the rollers in a sinuous path roller, they experience no bending action as they pass through the path.

Therefore, sinuous path mechanisms are not useful for woven fabrics. That is, when an element such as element 10 is passed over a single roller (not shown), the filaments 11 proximate to the roller will experience compression forces; the middle filaments 11 will be relatively neutral in applied force; and, the distal filaments 11 will undergo tension forces. According to the present invention however, as illustrated in FIG. 3, when fabric 12 is passed through flexing apparatus 20, all of the filaments 11 are subjected to the equal and opposite compression forces, and both fill elements 13 and warp elements 14 of a fabric 12 will be flexed and substantially debonded. The material may then be subjected to standard carbonization procedures, and the resulting product will remain flexible and strong, as will be exemplified hereinbelow.

It will be appreciated that even slight amounts of breaking of inter-filament bonds will provide an improvement in the flexibility in the resulting yarn or yarn product and would be within the scope of the invention. It is preferred however, that substantially all of the inter-filament bonds be broken. Furthermore, it will also be appreciated that inter-element bonding may also occur between yarn elements and yarn products, which may also be broken and which would be within the scope of the present invention.

General Experimental

In order to demonstrate the effectiveness of the present invention in providing a flexible, non-scoured carbon yarn, a number of flexible yarn elements and products were prepared according to the invention. For comparison, a number of comparative examples were also prepared and tested, as will be more fully discussed hereinbelow.

Example No. 1

In this example, a GRUPO CYDSA rayon-based yarn element was sized with "99" or CYDSA Std., which are proprietary sizings available from GRUPO CYDSA. None of the samples were scoured and equivalent samples of each were tested with flexing according to the present invention and without such flexing. Each sample was pre-carbonized by exposure to 700° F. for 12 hours, flexed or not flexed as required, and then carbonized by exposure to temperatures above about 2000° F. Heating was achieved by use of a conventional furnace. Furthermore, ten identical samples of each were tested for Break Strength after carbonizing, unit weight in grams per meter (g/m) and Tenacity in grams/denier (g/d). The average break strength was also determined between the ten samples of each yarn. The results of these tests are reported in TABLE I hereinbelow.

TABLE I

| | GRUPO CYDSA[a] | | | |
|---|---|---|---|---|
| Type SIZING | 99[b] | 99 | CYDSA[c] | CYDSA |
| SCOURED? | NO | NO | NO | NO |
| Precarbonized Mechanically Worked? | NO | YES | NO | YES |
| BREAK STR., lbs. after carbonizing | 0.50 | 1.20 | 0.80 | 1.60 |
| | 0.75 | 1.90 | 0.70 | 1.50 |
| | 0.90 | 1.50 | 0.80 | 1.40 |
| | 1.10 | 1.335 | 0.60 | 1.80 |
| | 1.00 | 1.60 | 0.70 | 1.30 |
| | 1.10 | 1.50 | 0.80 | 2.00 |
| | 1.00 | 1.80 | 0.75 | 1.40 |
| | 1.00 | 1.10 | 0.90 | 1.50 |
| | 1.10 | 1.55 | 0.90 | 1.20 |

TABLE I-continued

| | GRUPO CYDSA[a] | | | |
|---|---|---|---|---|
| Type SIZING | 99[b] | 99 | CYDSA[c] | CYDSA |
| | 0.95 | 1.00 | 0.90 | 1.20 |
| AVERAGE | 0.94 | 1.45 | 0.79 | 1.49 |
| UNIT WT., g/m | 0.0372 | 0.0325 | 0.0356 | 0.0342 |
| TENACITY, g/d | 1.27 | 2.25 | 1.11 | 2.20 |

[a]Rayon-based carbon yarn; 1 ply; 1650 denier; 750 filaments/element
[b]Mixture of starch and mineral oil
[c]CYDSA std. sizing form GRUPO CYDSA The results of the tests reported in TABLE I indicate that the unscoured and mechanically worked materials, i.e., flexed according to the present invention, were about twice as strong as the unscoured but not mechanically worked materials.

Example No. 2

In this example, samples were prepared as in Example No. 1, however, a number of the samples were flexed twice and a number of the control samples were scoured with perchloroethylene. The results of the tests of these samples is reported in TABLE II hereinbelow.

TABLE II

| | GRUPO CYDSA[a] | | | | | | | |
|---|---|---|---|---|---|---|---|---|
| Type SIZING | 99[b] | 99 | 99 | 99 | CYDSA[c] | CYDSA | CYDSA | CYDSA |
| EQUIPMENT | GLOBAR[d] | GLOBAR | GLOBAR | GLOBAR | GLOBAR | GLOBAR | GLOBAR | GLOBAR |
| SCOURED? | NO | NO | NO | YES | NO | NO | NO | YES |
| Pre-carbonized Mechanically Worked? | NO | ONCE | TWICE | NO | NO | ONCE | TWICE | NO |
| BREAK STR., lbs. | 0.7 | 2 | 1.5 | 1.30 | 0.7 | 1.7 | 1.4 | 2.10 |
| | 0.6 | 2.4 | 1.7 | 1.60 | 0.6 | 1.4 | 1.5 | 1.90 |
| | 0.7 | 1.5 | 1.8 | 1.10 | 0.5 | 1.6 | 1.6 | 1.50 |
| | 0.6 | 1.9 | 1.5 | 1.30 | 0.7 | 1.4 | 1.4 | 2.00 |
| | 0.8 | 1.9 | 1.3 | 1.30 | 0.4 | 1.6 | 1.5 | 2.00 |
| | 0.7 | 2.5 | 1.7 | 1.40 | 0.6 | 1.4 | 2.5 | 2.00 |
| | 0.8 | 2 | 1.5 | 2.00 | 0.7 | 1.8 | 1.4 | 2.00 |
| | 0.8 | 1.9 | 1.4 | 1.30 | 0.7 | 1.5 | 1.5 | 1.60 |
| | 0.8 | 1.8 | 1.5 | 2.00 | 0.7 | 2 | 2 | 1.60 |
| | 0.7 | 3 | 1.2 | 1.90 | 0.7 | 1.9 | 2 | 2.00 |
| AVERAGE | 0.72 | 2.09 | 1.51 | 1.52 | 0.63 | 1.63 | 1.68 | 1.87 |
| UNIT WT., g/m | 0.043 | 0.0429 | 0.043 | 0.0445 | 0.043 | 0.0415 | 0.0416 | 0.0422 |
| TENACITY, g/d | 0.84 | 2.46 | 1.77 | 1.72 | 0.74 | 1.98 | 2.04 | 2.24 |

[a]Rayon-based carbon yarn; 1 ply; 1650 denier; 750 filaments/element
[b]Mixture of starch and mineral oil
[c]CYDSA std. sizing from GRUPO CYDSA
[d]Heating element from The Carborundum Company The results reported in TABLE II provide further evidence that the unscoured and mechanically worked materials were about twice as strong as the unscoured but not mechanically worked materials. It is also shown that the unscoured and mechanically worked materials have comparable strengths to the standard scoured materials.

Example No. 3

In order to demonstrate the application of the invention to other carbon yarns, NARC-23, a 5-ply rayon cordage from North American Rayon was tested as above, with five samples each of six yarns, A–F, being tested. Three of the six yarn elements, A–C, were mechanically worked and three, D–F, were not, in order to provide a comparison. The results of this example are reported in TABLE III hereinbelow.

TABLE III

| NARC - 23[a] | | | | | | |
|---|---|---|---|---|---|---|
| | Mechanically Worked After Batch Pre-carbonizing | | | NOT Mechanically Worked After Batch Pre-carbonizing | | |
| Sample I.D. | A | B | C | D | E | F |
| Break Strength, lbs. | 12.00 | 15.50 | 10.60 | 3.50 | 2.50 | 3.00 |
| After Carbonizing: | 9.50 | 7.50 | 10.00 | 2.50 | 3.00 | 2.50 |
| | 8.50 | 9.00 | 12.00 | 3.50 | 3.50 | 3.50 |
| | 10.00 | 9.00 | 12.00 | 4.50 | 2.50 | 3.00 |
| | 8.50 | 11.00 | 12.00 | 3.50 | 2.00 | 3.50 |
| Average | 9.70 | 10.40 | 11.32 | 3.50 | 2.70 | 3.10 |

[a]North American Rayon; 5 ply rayon cordage made from 1650 denier; 720 filaments/element; 2 twists per inch The results of Example No. 3 again show that the samples according to the present invention A–C, were two to three times stronger than the unflexed comparison examples, D–F.

Example No. 4

In order to demonstrate the effectiveness of the present invention in providing a flexible yarn product, a carbon cloth having conventional warp and fill elements was prepared. Certain samples of the cloth were scoured or unscoured, and certain samples were mechanically worked or unworked, as indicated in TABLE IV hereinbelow. TABLE IV also indicates the test results of these samples.

effective in providing a flexible, non-scoured material. The invention is particularly suited for rayon-based carbon yarns, but is not necessarily limited thereto.

Based upon the foregoing disclosure, it should now be apparent that the use of the carbon yarn and methods described herein will carry out the objects set forth hereinabove. It is, therefore, to be understood that any variations evident fall within the scope of the claimed invention and thus, the selection of specific component elements can be determined without departing from the spirit of the invention herein disclosed and described. Thus, the scope of the invention shall include all modifications and variations that may fall within the scope of the attached claims.

What is claimed is:

1. A flexible yarn element comprising:

a plurality of pyrolized carbon filaments wherein each said filament is in contact with at least one other said filament;

a sizing material at least partially coating said plurality of filaments;

wherein said sizing material of each said filament is substantially separated from the sizing material of said at least one other said filament in contact therewith.

2. A yarn element, as set forth in claim 1, wherein said sizing material is selected from the group consisting of starch, mineral oil, wetting agents and mixtures thereof.

3. A yarn element, as set forth in claim 1, wherein said carbon filaments are rayon-based.

4. A flexible, carbonizable yarn product containing a plurality of pre-carbonization pyrolized yarn elements,

TABLE IV

| Unscoured vs. Scoured - Flexed vs. As is Carbon Cloth | | | | | | |
|---|---|---|---|---|---|---|
| | Sample I.D. | | | | | |
| | Cydsa 1A[a] UNSCOURED | Cydsa 2A[a] UNSCOURED | Narc 1B[b] UNSCOURED | Narc 2B[b] UNSCOURED | Control[c] Narc 1C SCOURED | Control[c] Narc 2C SCOURED |
| Mechanically Worked Before Pre-carbonizing? | No | Yes | No | Yes | No | Yes |
| Break Strength - Warp, lbs./in. | 18 | 25 | 30 | 39 | 40 | 44 |
| | 18 | 26 | 33 | 35 | 36 | 45 |
| | 21 | 26 | 29 | 42 | 40 | 43 |
| | 20 | 24 | 31 | 42 | 36 | 34 |
| | 23 | 22 | 33 | 32 | 34 | 41 |
| | 26 | 28 | 30 | 27 | 35 | 45 |
| | 18 | 29 | 29 | 32 | 34 | 46 |
| | 17 | 24 | 31 | 33 | 42 | 42 |
| | 19 | 23 | 32 | 39 | 35 | 43 |
| Average, lbs./in. | 20.0 | 25.2 | 30.9 | 35.7 | 36.9 | 42.6 |
| Break-Strength - Fill, lbs./in. | 13 | 16 | 24 | 31 | 19 | 22 |
| | 15 | 16 | 20 | 25 | 20 | 22 |
| | 13 | 14 | 21 | 29 | 18 | 23 |
| | 12 | 13 | 25 | 24 | 20 | 17 |
| | 14 | 14 | 19 | 24 | 21 | 19 |
| | 14 | 12 | 18 | 27 | 19 | 25 |
| | 10 | 15 | 24 | 26 | 18 | 20 |
| | 13 | 15 | 21 | 24 | 22 | 18 |
| | 12 | 14 | 22 | 24 | 17 | 20 |
| Average, lbs./in. | 12.9 | 14.3 | 21.6 | 26.0 | 19.3 | 20.7 |

[a]GRUPO CYDSA rayon woven into an 8 harness satin cloth
[b]North American Rayon rayon woven into an 8 harness satin cloth
[c]North American Rayon rayon woven into an 8 harness satin cloth The results in TABLE IV again show that the unscoured and mechanically worked materials are stronger than the comparable comparison unscoured and/or not mechanically worked materials.

Thus it should be evident that the carbon yarns, yarn products and methods of the present invention are highly wherein the yarn elements are comprised of a plurality of individual filaments in contact with adjacent filaments and the filaments are at least partially coated with at least one sizing material, and wherein the yarn elements are substantially free from inter-filament bonding of said sizing material.

5. The flexible, pre-carbonization pyrolized, carbonizable yarn product as in claim 4 wherein the filaments are derived from a carbonizable material selected from the group consisting of rayon, acrylonitrile, pitch, phenolic resins, and mixtures thereof.

6. The flexible, pre-carbonization pyrolized, carbonizable yarn product as in claim 4 wherein the filaments are derived from rayon.

7. The flexible, pre-carbonization pyrolized, carbonizable yarn product as in claim 4 wherein the sizing material is selected from the group consisting of starch, mineral oil, wetting agents and mixtures thereof.

8. A woven fabric comprising the flexible, pre-carbonization pyrolized, carbonizable yarn product as in claim 4.

9. A carbonized yarn product derived from the flexible, pre-carbonization pyrolized, carbonizable yarn product of claim 4.

* * * * *